US007654711B2

(12) United States Patent
Cheng

(10) Patent No.: US 7,654,711 B2
(45) Date of Patent: Feb. 2, 2010

(54) LAMP ASSEMBLY

(75) Inventor: Te-Chang Cheng, Do-Liu (TW)

(73) Assignee: Mylar Electronics Co., Ltd., Taipei (TW)

( * ) Notice: Subject to any disclaimer, the term of this patent is extended or adjusted under 35 U.S.C. 154(b) by 86 days.

(21) Appl. No.: 12/099,152

(22) Filed: Apr. 8, 2008

(65) Prior Publication Data

US 2009/0251904 A1 Oct. 8, 2009

(51) Int. Cl.
*F21S 8/08* (2006.01)

(52) U.S. Cl. ..... 362/414; 362/260; 362/411; 362/431

(58) Field of Classification Search ..... 362/260, 362/410, 411, 413, 414, 431
See application file for complete search history.

(56) References Cited

U.S. PATENT DOCUMENTS 5,938,316 A * 8/1999 Yan ..... 362/260
6,206,545 B1 * 3/2001 Yan ..... 362/241
6,439,748 B1 * 8/2002 Hsieh ..... 362/360

* cited by examiner

*Primary Examiner*—Jason Moon Han

(57) ABSTRACT

A lamp assembly includes a light module and a stem. The light module includes a reflector, a first fixing plate, a second fixing plated mounted on the first fixing plate and having a plurality of fixing pieces pivotally connected thereon for fixing the reflector between the first fixing plate and the second fixing plate, and a lamp. By rotating the fixing pieces, the reflector is easy to replace. The stem includes a plurality of connecting tubes and connecting assemblies. Each connecting assembly has a male joint with an L-shape projecting and a female joint with an L-shape slot. The male joint is fitted into the connecting tube, and the female joint is fitted into another connecting tube. By engaging the L-shape projection with the L-shape slot, the two connecting tubes can be connected without twisting a wire inside the stem.

13 Claims, 6 Drawing Sheets

LAMP ASSEMBLY

BACKGROUND OF THE INVENTION

1. Field of the Invention

The present invention generally relates to a lamp assembly, and in particular to a lamp assembly which is easy to repair and can prevent wire twisting inside a lamp stem.

2. The Prior Arts

Referring to FIG. 1, a conventional lamp assembly 1 comprises a light source 11, a stem 12 having an end coupled to the light source 11, and a base 13 coupled to the other end of the stem 12. The light source 11 comprises a reflector 110, a first fixing plate 111 mounted to a first end of the reflector 110 and a second fixing plate 112 mounted to a second end of the reflector 110 by bolts and nuts, an electronic ballast 114 fixed on the second fixing plate 112, and a lamp 113 disposed on the electronic ballast 114, in which the reflector 110 is fixed between the first fixing plate 111 and the second fixing plate 112. The conventional light source 11 has the shortcoming that it is difficult to replace the reflector 110 when the reflector 110 is broken. Each component of the light source 11 has to be disassembled from the light source 11 and reassembled together again after replacing a new reflector, which complicates the repair and will cost a lot of time.

As shown in FIGS. 1 and 2, the stem 12 comprises three connecting tubes 121 and two connectors 122 connecting the connecting tubes 121. Each of the connector 122 has external threads 123 formed on both ends thereof for screwing with internal threads of the connecting tubes 121. To assemble the stem 12, each of the connecting tube 121 and connector 122 are screwed tight together by rotation, which easily causes wire twisting inside the stem 12.

SUMMARY OF THE INVENTION

A primary objective of the present invention is to provide a lamp assembly having a light module and a stem, which is easy to repair and can prevent wire twisting inside the stem.

Accordingly, the light module comprising a first fixing plate, a second fixing plate mounted on the first fixing plate and having a plurality of fixing pieces pivotally connected on a periphery of the second fixing plate, a reflector having an opening for allowing the second fixing plate to pass through and fixed between the first fixing plate and the second fixing plate by the fixing pieces, an electronic ballast disposed on the second fixing plate, and a lamp disposed on the electronic ballast. By rotating the fixing pieces, the reflector can be easily disassembled from and assembled with the light module without disassembling the whole light module. The stem comprises a plurality of connecting tubes and a plurality of connecting assemblies connecting the connecting tubes, in which each connecting assembly has a male joint with an L-shape projection at one end, a female joint with an L-shape slot at one end corresponding to the L-shape projection of the male joint, and a decoration ring arranged between the male joint and female joint. It only needs to make a small rotation to engage the male joint with the female joint, and therefore it prevents the wire twisting inside the stem.

The male joint according to the present invention has a plurality of external vertical ridges formed at the opposite end of the L-shape projection for engaging with a plurality of internal vertical grooves of the connecting tube. The male joint is directly fitted into the connecting tube without rotation, and therefore it prevents the wire twisting inside the stem.

The female joint according to the present invention has external vertical ridges at the external surface for engaging with a plurality of internal vertical grooves of the connecting tube. The female joint is directly fitted into the connecting tube without rotation, and therefore it prevents the wire twisting inside the stem.

BRIEF DESCRIPTION OF THE DRAWINGS

The present invention will be apparent to those skilled in the art by reading the following detailed description of a preferred embodiment thereof, with reference to the attached drawings, in which.

DETAILED DESCRIPTION OF THE PREFERRED EMBODIMENT

Figure 1:
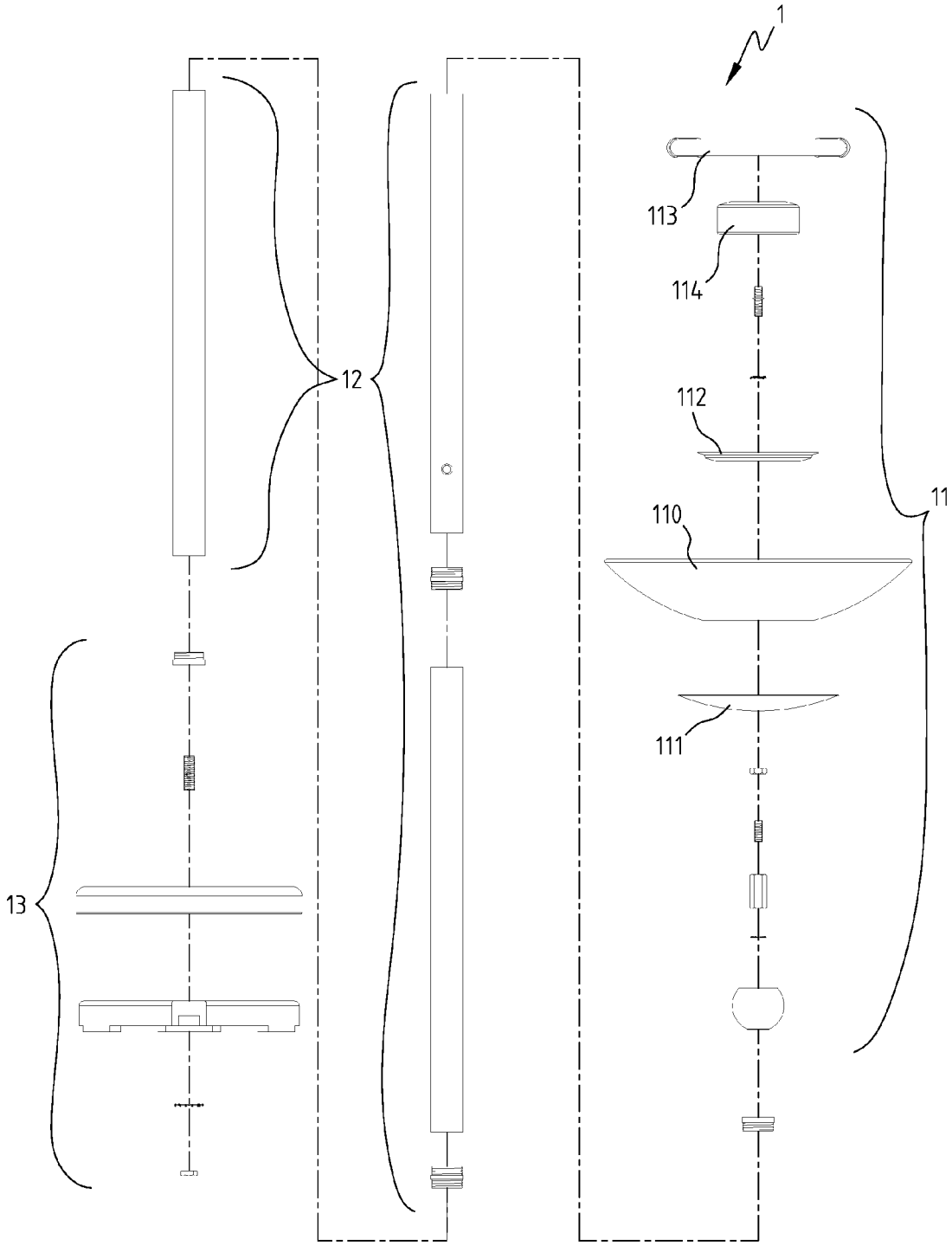
FIG. 1 is an exploded view of a conventional lamp assembly.
Figure 2:
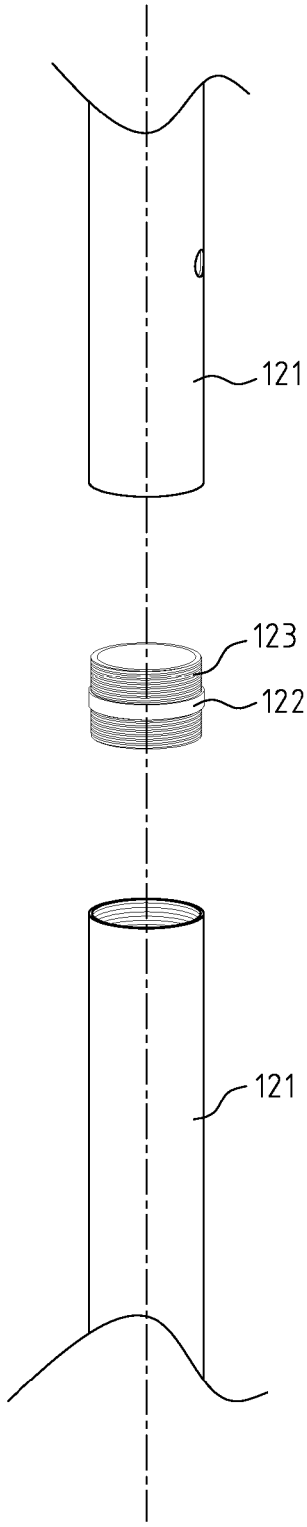
FIG. 2 is an exploded view showing a stem of the conventional lamp assembly.
Figure 3:
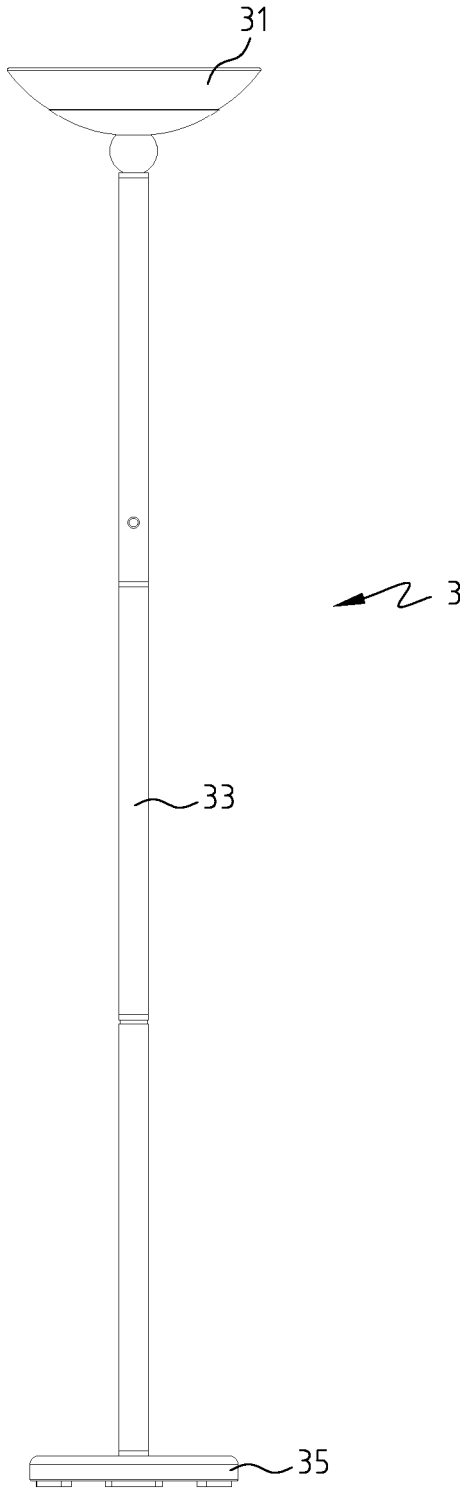
FIG. 3 is a perspective view showing a lamp assembly in accordance with the present invention.

Referring to FIG. 3, a lamp assembly 3 in accordance with an embodiment of the present invention comprises a light module 31, a stem 33 having an end coupled to the light module 31, and a base 35 coupled to the other end of the stem 33.

Figure 4:
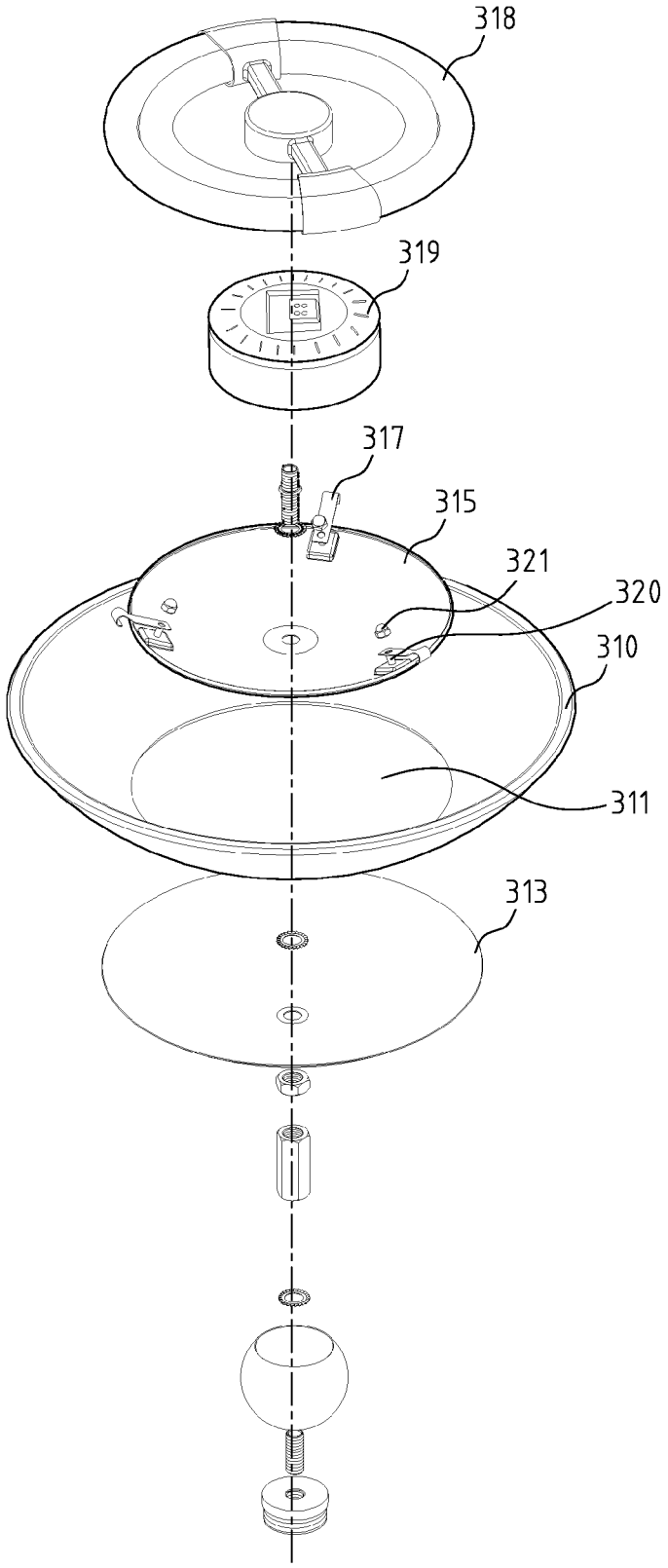
FIG. 4 is an exploded view showing a light module of the lamp assembly in accordance with the present invention.

Referring to FIG. 4, the light module 31 comprises a first fixing plate 313, a second fixing plate 315 mounted on the first fixing plate 313 and having three fixing pieces 317 pivotally connected on a periphery of the second fixing plate 315, an electronic ballast 319 mounted on the second fixing plate 315, a reflector 310 having an opening 311 for allowing the second fixing plate 315 to pass through and fixed between the first fixing plate 313 and the second fixing plate 315 by the fixing pieces 317, a lamp 318 disposed on the electronic ballast 319. An inner diameter of the opening 311 of the reflector 310 is slightly greater than the outer diameter of the second fixing plate 315 and smaller than the outer diameter of the first fixing plate 313. The fixing pieces 317 are pivotally connected on the second fixing plate 315 by bolts 320 and nuts 321. Thus, the fixing pieces 317 can be rotated to project outside of the second fixing plate 315 and can be rotated to withdraw inside of the second fixing plate 315. When the fixing pieces 317 are rotated inward, the second fixing plate 315 is allowed to pass through the opening 311 of the reflector 310. The opening 311 of the reflector 310 is located between the first fixing plate 313 and the second fixing plate 315. When the fixing pieces 317 are rotated to project outside of the second fixing plate 315, the second fixing plate can not pass through the opening 311 of the reflector 310. Therefore, the reflector 310 is fixed between the first fixing plate 313 and the second fixing plate 315. The fixing pieces 317 are made of metal, and the reflector 310 is made of glass, but not limit to this.

Figure 5:
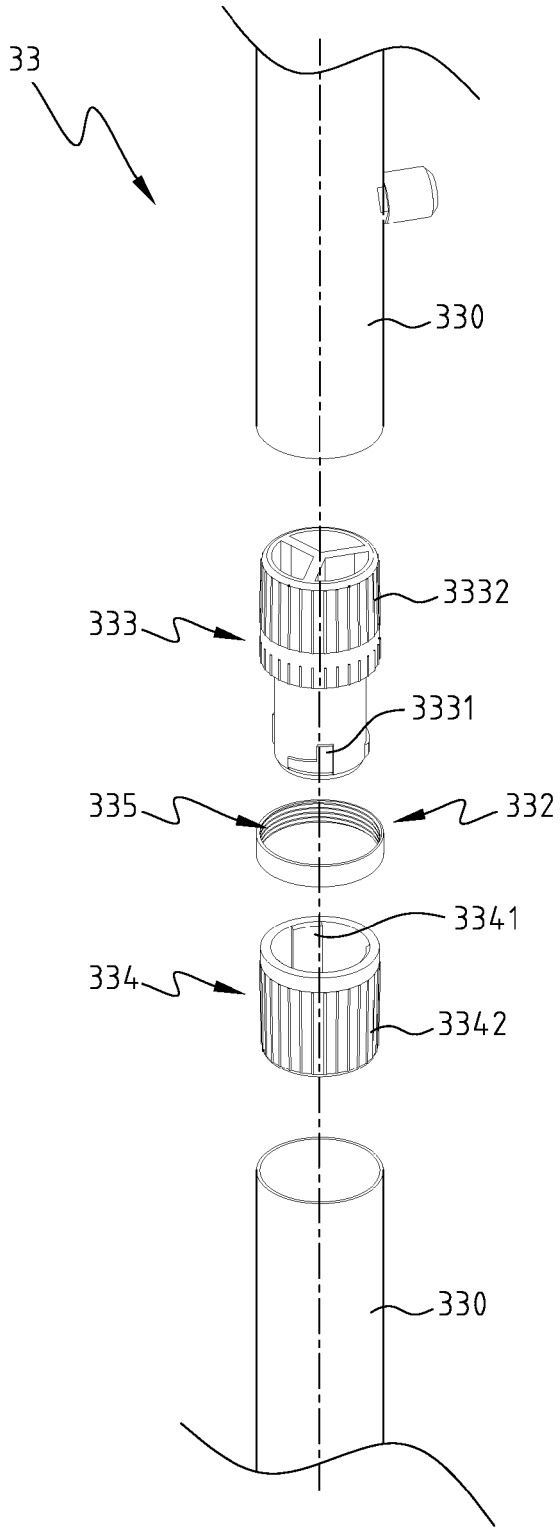
FIG. 5 is an exploded view showing a stem of the lamp assembly in accordance with the present invention.

As shown in FIGS. 3 and 5, the stem 33 comprises three connecting tubes 330 and two connecting assemblies 332 connecting the connecting tubes 330. Each of the connecting assembly 332 has a male joint 333, a female joint 334, and a decoration ring 335 disposed between the male joint 333 and female joint 334. The male joint 333 has an L-shape projection 3331 at one end, and the female joint 334 has an L-shape slot 3341 at one end corresponding to the L-shape projection 3331 of the male joint 333. Thus, the male joint 333 can be inserted into female 334 and rotated by a small angle, thereby engaging the L-shape projection 3331 of the male joint 333 with the L-shape slot 3341 of the female joint 334. The male joint 333 further has a plurality of external vertical ridges 3332 formed at the opposite end of the L-shape projection 3331 for engaging with a plurality of internal vertical grooves of the connecting tube 330. The female joint 334 has a plurality of external vertical ridges 3342 at external surface thereof for engaging with a plurality of internal vertical grooves of the connecting tube 330. Thus, the male joint 333 can be directly fitted into the connecting tube 330 and the female joint 334 can be directly fitted into the connecting tube 330 without rotation. The male joint 333 and female joint 334 are made of plastic or metal according to the embodiment.

In the embodiment mentioned above, the metal may be copper, stainless steel, aluminum, titanium, or other like material; the plastic may be polyvinyl chloride (PVC), polycarbonate (PC), polyethylene terephthalate (PET), polystyrene (PS), polyethylene (PE), polypropylene (PP), or other like material. The connecting tubes 330 and connecting assemblies 332 are provided to form the stem 33. The connecting tubes 330 may be formed in different lengths according to the requirement.

Figure 6:
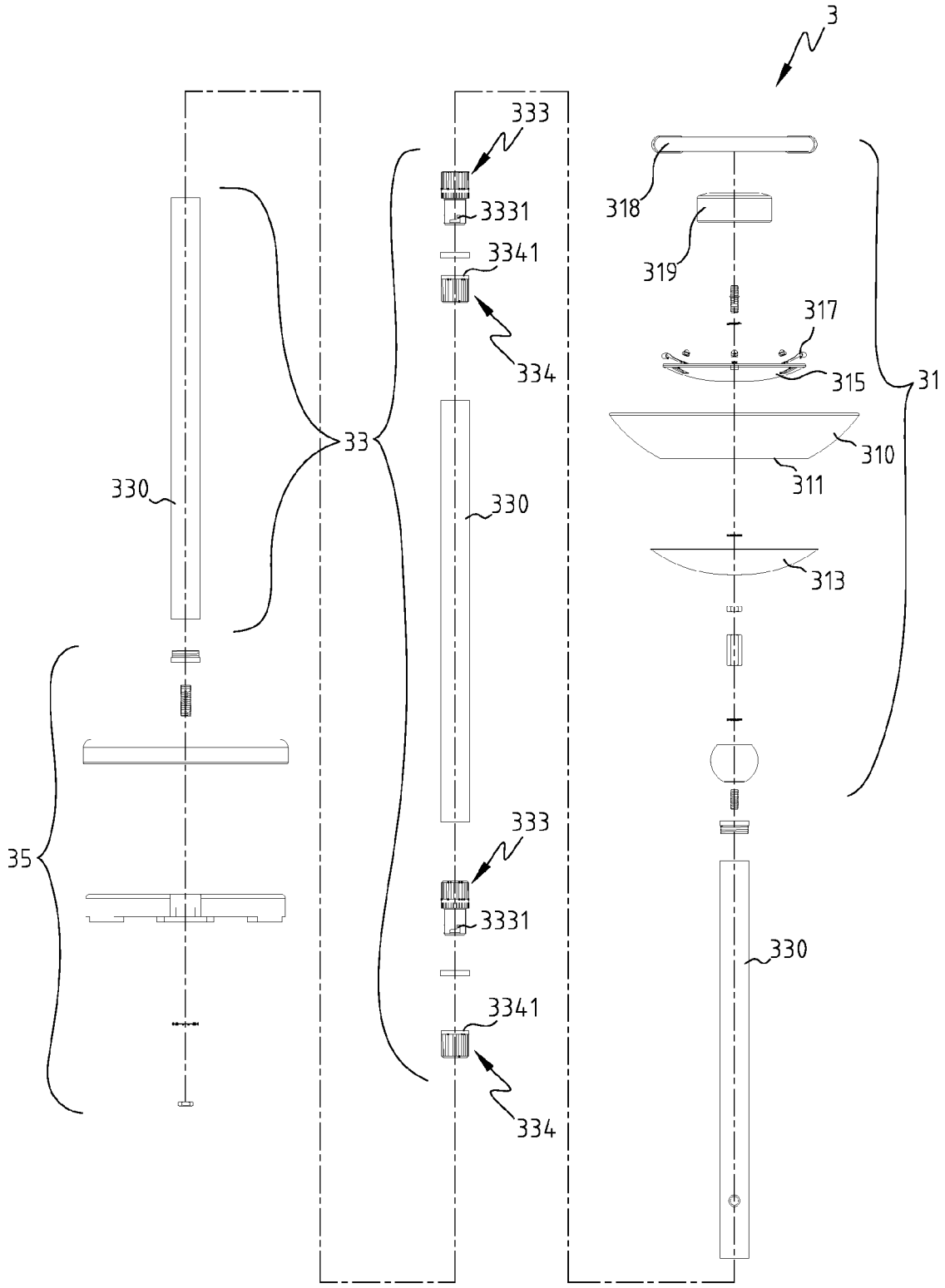
FIG. 6 is an exploded view showing the lamp assembly in accordance with the present invention.

Referring to FIG. 6, to assemble the lamp assembly 3, the base 35 is first assembled. An end of a connecting tube 330 is coupled to the base 35; the female joint 334 is fitted into the other end of the connecting tube 330; the male joint 333 is fitted into an end of the other connecting tube 330; the male joint 333 and female joint 334 are engaged together by inserting the L-shape projection 3331 of the male joint 333 into the L-shape slot 3341 of the female joint 334 and counter-rotating the two connecting tubes 330, such that the two connecting tubes 330 can be connected; in this way, a plurality of connecting tubes 330 are connected to formed the stem 33. The light module 31 is then assembled; the first fixing plate 313 and the second fixing plate 315 are connected together; the fixing pieces 317 of the second fixing plate 315 are rotated inward to allow the second fixing plate 315 pass through the opening 311 of the reflector 310, so that the reflector 310 is between the first fixing plate 313 and the second fixing plate 315; the fixing pieces 317 are then rotated outward to fix the reflector 310 between the first fixing plate 313 and the second fixing plate 315; the electronic ballast 319 is mounted on the second fixing plate 315 and the lamp 318 is disposed on the electronic ballast 319. The light module 31 is coupled to the other end of the stem 33. By rotating the fixing pieces 317, the reflector 310 can be easily assembled with and disassembled from the light module 31 without disassembling the light module 31. Further, without using the screwing joint, the connecting assemblies 332 can prevent wire twisting inside the connecting tube 330 when the connecting tube 330 is assembled.

Although the present invention has been described with reference to the preferred embodiment thereof, it is apparent to those skilled in the art that a variety of modifications and changes may be made without departing from the scope of the present invention which is intended to be defined by the appended claims.

What is claimed is:

1. A lamp assembly, comprising:

a light module comprising a first fixing plate, a second fixing plate mounted on the first fixing plate and having a plurality of fixing pieces pivotally connected on a periphery of the second fixing plate, an electronic ballast mounted on the second fixing plate, a reflector having an opening for allowing the second fixing plate to pass through and fixed between the first fixing plate and the second fixing plate by the fixing pieces, and a lamp disposed on the electronic ballast;

a stem having an end coupled to the light module, and comprising a plurality of connecting tubes and a plurality of connecting assemblies connecting the connecting tubes; and a base coupled to the other end of the stem;

wherein an inner diameter of the opening of the reflector is greater than an outer diameter of the second fixing plate, and smaller than an outer diameter of the first fixing plate, the fixing pieces of the second fixing plate are rotated inward for allowing the second fixing plate to pass through the opening of the reflector, the fixing pieces are rotated outward for fixing the reflector between the first fixing plate and the second fixing plate, and each connecting assembly has a male joint with an L-shape projection at one end and a female joint with an L-shape slot at one end corresponding to the L-shape projection of the male joint.

2. The lamp assembly as claimed in claim 1, wherein the reflector is made of glass.

3. The lamp assembly as claimed in claim 1, wherein three fixing pieces are evenly spaced on the periphery of the second fixing plate.

4. The lamp assembly as claimed in claim 1, wherein the fixing pieces are pivotally connected on the second fixing plate by nuts and bolts.

5. The lamp assembly as claimed in claim 1, wherein the fixing pieces are made of metal.

6. The lamp assembly as claimed in claim 1, wherein the fixing pieces are made of one of copper, stainless steel, aluminum, and titanium.

7. The lamp assembly as claimed in claim 1, wherein the male joint has a plurality of external ridges formed at the opposite end of the L-shape projection for engaging with a plurality of internal grooves of the connecting tube.

8. The lamp assembly as claimed in claim 1, wherein the female joint has a plurality of external ridges formed on the external surface of the female joint for engaging with a plurality of internal grooves of the connecting tube.

9. The lamp assembly as claimed in claim 1, wherein the male joint and the female joint are made of metal.

10. The lamp assembly as claimed in claim 1, wherein the male joint and the female joint are made of one of copper, stainless steel, aluminum, and titanium.

11. The lamp assembly as claimed in claim 1, wherein the male joint and the female joint are made of plastic.

12. The lamp assembly as claimed in claim 1, wherein the male joint and the female joint are made of one of polyvinyl chloride (PVC), polycarbonate (PC), polyethylene terephthalate (PET), polystyrene (PS), polyethylene (PE), and polypropylene (PP).

13. The lamp assembly as claimed in claim 1, wherein a decoration ring is disposed between the male joint and the female joint.

* * * * *